United States Patent [19]

Korosue

[11] Patent Number: 4,776,304

[45] Date of Patent: Oct. 11, 1988

[54] MOVEMENT CONVERTER FOR USE IN AN ENGINE AND THE LIKE

[76] Inventor: Akira Korosue, 6-604, Tashiro-cho 19, Nishinomiya City, Hyogo, Japan

[21] Appl. No.: 932,328

[22] Filed: Nov. 19, 1986

[30] Foreign Application Priority Data

Nov. 19, 1985 [JP] Japan ..... 60-259336

[51] Int. Cl.[4] ..... F02B 75/18; F02B 75/32

[52] U.S. Cl. ..... 123/56 AC; 123/197 AC; 417/534; 417/343; 417/364; 417/399

[58] Field of Search ..... 123/55 R, 55 A, 56 R, 123/56 AC, 56 BC, 56 C, 193 C, 197 R, 197 AB, 197 AC; 417/521, 531, 534, 539, 339, 341, 343, 364, 374, 380, 399; 74/50

[56] References Cited

U.S. PATENT DOCUMENTS

| | | | |
|---|---|---|---|
| 2,050,603 | 3/1933 | Gardner | 418/38 |
| 2,086,302 | 7/1937 | Schlenker | 123/56 AC |
| 2,132,595 | 10/1938 | Bancroft | 123/56 AC |
| 2,815,901 | 12/1957 | Hale | 417/534 |
| 3,274,982 | 9/1966 | Noguchi et al. | 123/56 C |
| 3,878,768 | 4/1975 | Kress | 417/534 X |
| 4,140,440 | 2/1979 | Ferris | 123/56 BC X |
| 4,192,261 | 3/1980 | Berg | 123/197 AB X |
| 4,387,672 | 6/1983 | Crocker | 123/56 C X |
| 4,459,945 | 7/1984 | Chatfield | 123/197 A X |
| 4,641,611 | 2/1987 | Stiller et al. | 123/193 C X |
| 4,682,569 | 7/1987 | Stiller et al. | 123/56 AC X |

OTHER PUBLICATIONS

"A History of the Combustion Engine" published by Sanei Shobou on Dec. 25, 1969, pp. 241, 246.

*Primary Examiner*—Willis R. Wolfe, Jr.

*Attorney, Agent, or Firm*—Birch, Stewart, Kolasch & Birch

[57] ABSTRACT

A movement converter for use in a combustion engine or as an air compressor wherein reciprocating motion of a piston is converted to rotational motion of an output shaft or a rotational motion of an input shaft is converted to a reciprocating motion of the piston. The movement converter for use in the engine not only attains an improvement in the balance in comparision with conventional reciprocating type engines but allows the mechanical efficiency to be high enough to be placed into practical use concurrently with its physical dimension being smaller and lighter. The movement converter employs a crosswise disposition of the four cylinders and the interactive use of links together with a Z crank for converting the resulting swinging motion to rotational motion so that all the vibration, including the primary vibration and the secondary vibration, are dissolved by means of an interactive offset. If rotary motion is imparted to the Z crank shaft it is transfered to a perpendicular connecting bearing and a crank pin to impart a to and fro rotation to links for reciprocating the pistons for compressing a gas disposed within the cylinders. If reciprocating motion is imparted to the pistons, a to and fro motion is imparted to the links for rotating a rotatable shaft and a yoke connected to the perpendicular connecting bearing for rotating the Z crank shaft.

13 Claims, 6 Drawing Sheets

FIG. 2(I)
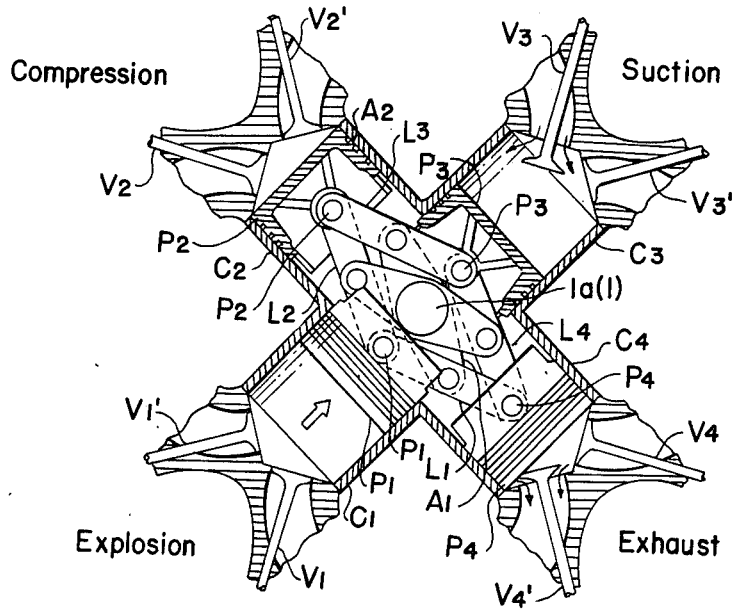
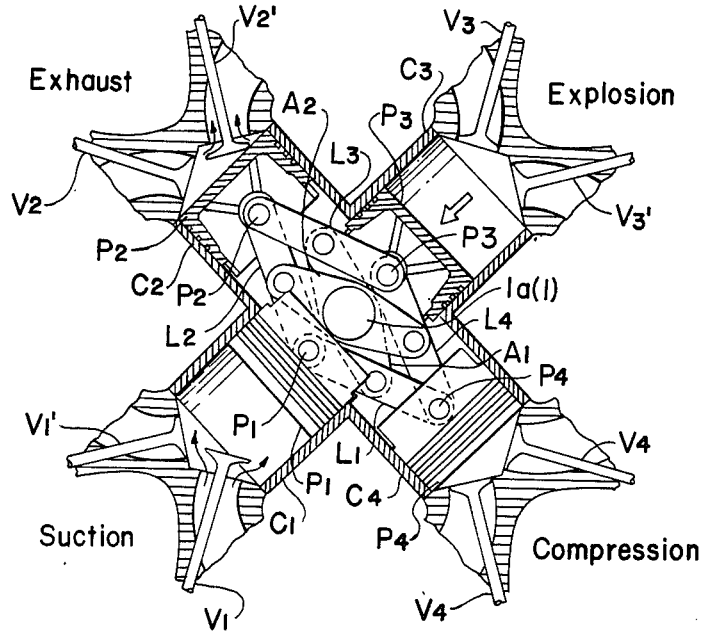
FIG. 2(III)

FIG. 2(II)
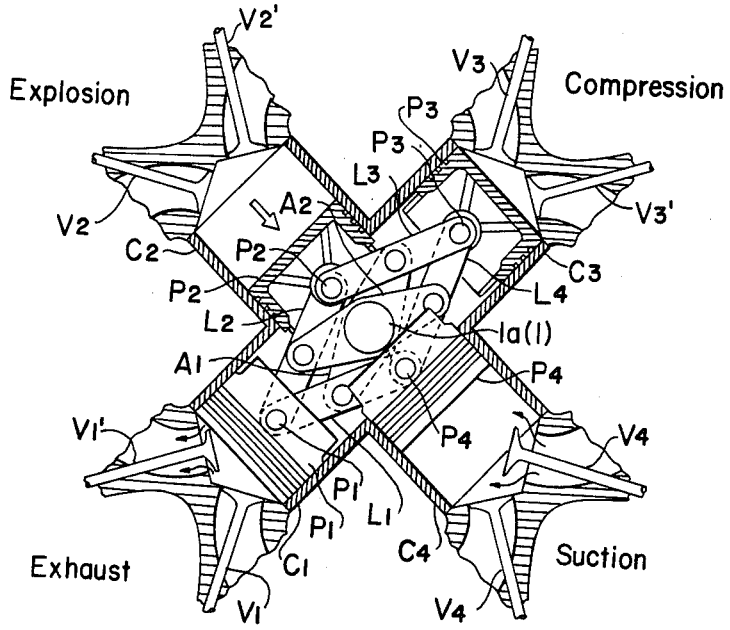
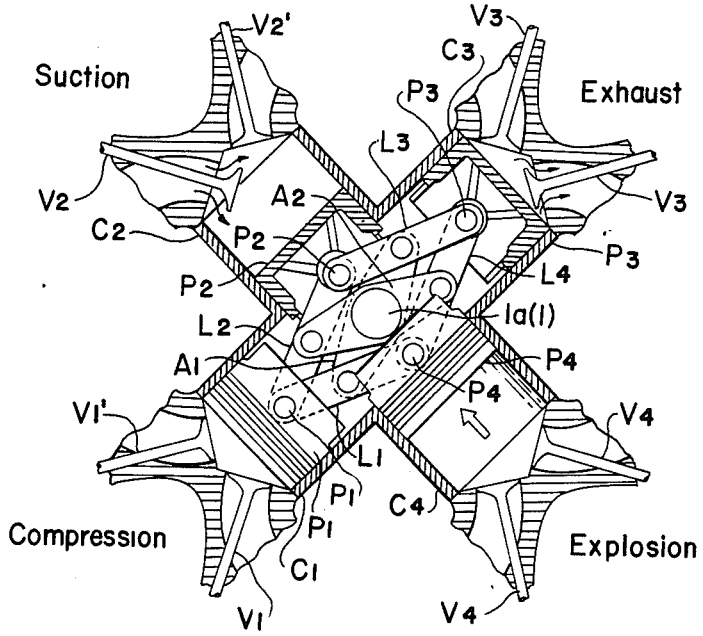
FIG 2(IV)

MOVEMENT CONVERTER FOR USE IN AN ENGINE AND THE LIKE

BACKGROUND OF THE INVENTION

1. Field of the Invention

The present invention relates to a movement converter for converting the reciprocating motion of a piston and the rotational motion of an input shaft to the rotational motion of an output shaft and the reciprocating motion of the piston respectively in the case of a reciprocating type combustion engine and an air compressor. More specifically, to a movement converter for use in an engine which makes an improvement in the balance of a kinematic system and attains a reduction in vibration.

2. Description of Background Art

In a conventional series type reciprocating engine and air compressor, it is known that, in order to make the rotation smooth and reduce the vibration at the same time, the rotational shaft is provided with a fly wheel and a rotational balance weight. In this case, in the series type 4-cylinder engine, for example, a primary vertical vibration, due to the inertial unbalance, which is caused once per one rotation mainly by the motion of the piston, can be reduced to nil. However, in order to take away the vibrations which take place at even times due to rolling and the like of a connecting rod, a countermeasure is the balance weight which permits the vibration to be reduced as much as possible or that a balancer having a mechanical function is provided to eliminate the vibration. In the case where the balance weight is used, since the vibration which is incurred from the engine is not transmitted, the thickness of a cylinder block is made thicker, and a complicated vibration proof structure of the engine room is provided. On the other hand, while using the balancer, it is unavoidable that the mechanism becomes complicated.

For the purpose of reducing vibrations, various proposals have been hitherto set forth to improve the balance of the engine. For example, mechanisms which attain a reduction in the vibration by means of causing an adaption of the piston to be directly and swingingly moved in a symmetrical manner with an improvement in the balance of the engine aimed at converting its motion to the rotational motion are found in the engine according to U.S. Pat. No. 2,050,603, English Sellwood type engine, *A History of the Combustion Engine,* P. 241, published by Sanei Shobou on Dec. 25, 1969, and the Bradshaw engine, *A History of the Combustion Engine,* P. 246. In the above-identified examples, circular-shaped cylinders and the pistons are disposed in a doughnut shape so that the swinging motion may directly take place, thereby converting the motion to the rotational motion. However, such a mechanism has not been placed into practical use, because there is a difficulty in processing the cylinder and the piston and a defect occurs in terms of airtightness. Furthermore, page 260 of the aforementioned *A History of the Combustion Engine* refers to the American Caminez-called engine. In order to improve the balance of this 4-cylinder engine, the cylinders are radially disposed and four equilateral links are used. Such an engine adopts a system in which a line contact between a roller being mounted inside the piston and a cocoon-shape causes the roller to be rolled at high speed so that a stress around the part where the roller contacts with the cam, adjacent to the area subject to an explosion, is so large that such a part is easy to wear, thus resulting in a problem that the engine in question cannot be put into practical use in terms of durability.

In addition, according to the engine shown in Pat. No. 236,540, a wobble cam plate mechanism is disclosed for converting the reciprocating motion of the piston to rotational motion in place of the swinging motion. Almost all of the motion of the piston adopts a form of an axial piston parallel to the output shaft and the structure of a joint part wherein the line motion of the piston converted to the swinging motion becomes complicated so that a problem in terms of durability is still unsolved. This results in a case of frequently needing a rotating stopper for the movable cam.

SUMMARY AND OBJECTS OF THE INVENTION

Accordingly, the purpose of the present invention is to provide a movement converter for use in the engine and the like which not only attains an improvement in the balance in comparison with the model found in the conventional reciprocating type engine, but allows the mechanical efficiency to be high enough to be placed into practical use concurrently with its physical dimension being small and lighter.

More specifically, the movement converter employs a crosswise disposition of the four cylinders and the interactive use of the links to give rise to the help of a Z crank for converting the resulting swinging motion to rotational motion so that all the vibration, including the primary vibration and the secondary vibration, are dissolved by means of an interactive offset, while having a surface contact or a rolling contact comprising a multiplicity of contact parts, such as ball bearings, constituting the contact part of the movement conversion bringing high durability thereto. From the point of a view of reliability, the load conditions and the lubrication conditions of the piston reach the same level to that which is in conformity with engines of the current standards.

The objects of the present invention are achieved by providing a movement converter having an arrangement in which the four cylinders $C_1$, $C_2$, $C_3$, and $C_4$ are disposed crosswise such that two groups of a pair of cylinders are disposed oppositely to each other on the same shaft line have their shaft lines connected perpendicularly to each other on the one plane. End parts of the four equilateral links $L_1$, $L_2$, $L_3$, and $L_4$ are adapted to be interactively mounted to the piston pins $p_1$, $p_2$, $p_3$, and $p_4$ respectively of the pistons $P_1$, $P_2$, $P_3$, and $P_4$ in the cylinders such that the piston pins adjoining to each other are connected thereto. The end parts of the cross arms $A_1$ and $A_2$, intersected to each other in an X-shaped manner, are adapted to be mounted to the middle points respectively of the two groups of a pair of parallel links $L_1$ & $L_3$ and $L_2$ & $L_4$ being opposite to each other. The movable shaft 1, being located at the intersecting point between the middle points of the above-mentioned cross arms, is provided perpendicularly to the actuating face of the arms on one cross arm $A_1$ such that the movable shaft 1 is rotatable to and fro, and its shaft end is adapted to be equipped with the yoke 2 having a fork end.

The shaft line of the rotational shafts *4a* and *4b* of the Z crank shaft 3 is disposed perpendicularly to a direction of the shaft line of the aforementioned movable shaft 1. Movable pins *6a* and *6a* are provided perpendicularly to both the sides, respectively, of the shaft line of the perpendicular connecting bearing 6 which is slidably fitted onto the crank pin 5. The crank pin 5 is connected to the shaft line of said rotational shafts 4a and 4b in an inclining manner and is located between the rotational shafts 4a and 4b. The movable pins 6a and 6a are constructed to be insertively supported between a pair of arms 2a and 2a to the aforementioned yoke 2. If necessary, one more movable shaft 1a, coaxial to the aforementioned movable shaft 1, may be fixed to the arm $A_2$ which is located oppositely of the yoke 2 of the cross arm $A_1$ and the movable balance weight 10 is fixed to said movable shaft 1a. Thereby, the swinging motion from the reciprocating motion of the piston is removed which results in a conversion to the rotational motion performed by way of the yoke 2 and the perpendicular connecting bearing 6 by means of the Z crank shaft 3.

Under such an arrangement, if two groups of a pair of pistons, opposite to each other, are reciprocally moved or double acted with the cross arms $A_1$ and $A_2$ being intersected with each other and moved from each other in a shaking manner, the resulting shaking motion of the yoke 2 on the end part of the movable shaft 1 fixed to one cross arm $A_1$ causes the perpendicular connecting bearing 6 supported by the yoke to impart a double-sided spherical sliding motion to the crank pin 5. The Z crank shaft 3 is rotated because its shaft center is fixed at the rotational shafts 4a and 4b. At that time, the four equilateral links permit each of the pistons to be actuated, while said pistons are restricted in their actuating mode, and two groups of two pistons, opposite to each other, are symmetrically actuated with the intersecting point of the diagonals of the four links as a center.

Thus, the motion of the piston and the link is fully balanced, thereby preventing them from being vibrated. Furthermore, the balance weights on both the ends of the crank pins allow an unbalance of a couple along the Z crank shaft to be offset so that it is reduced to nil. The motion of the perpendicular connecting bearing is divided into a component of the rotational motion, double-sided spherical sliding motion, around the crank pin and a component of the shaking motion in vicinity of the movable pin. The rotational balance weights 15 and 15 which are provided on the rotational shafts 4a and 4b on both the sides of the crank pin 5 and the movable balance weight 10 which, if necessary, is connected directly to the cross arm $A_2$ and located at the side to which the yoke is not fixed and moved in a shaking manner in a direction reverse to the cross arm $A_1$ on the side of yoke permitting each of the above-mentioned kinematic components to keep its balance. Whereby, the well-balanced construction including that of the aforementioned piston motion is, as a whole, attained, resulted in a reduction in the vibration amount of the entirety of the device. However, so far as a small machine is concerned, a practical use of the movable balance may not be frequently needed, because adding a slight amount of weight to the rotational balance weights 15 and 15 which are provided on the rotational shafts 4a and 4b enables an angular vibration to be reduced by half.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 2-(I), 2-(II), 2-(III), and 2-(IV) are sectional plan views of the action sequence of the principal part of the cylinder of the engine and its related part;

DETAILED DESCRIPTION OF THE PREFERRED EMBODIMENTS

Figure 1:
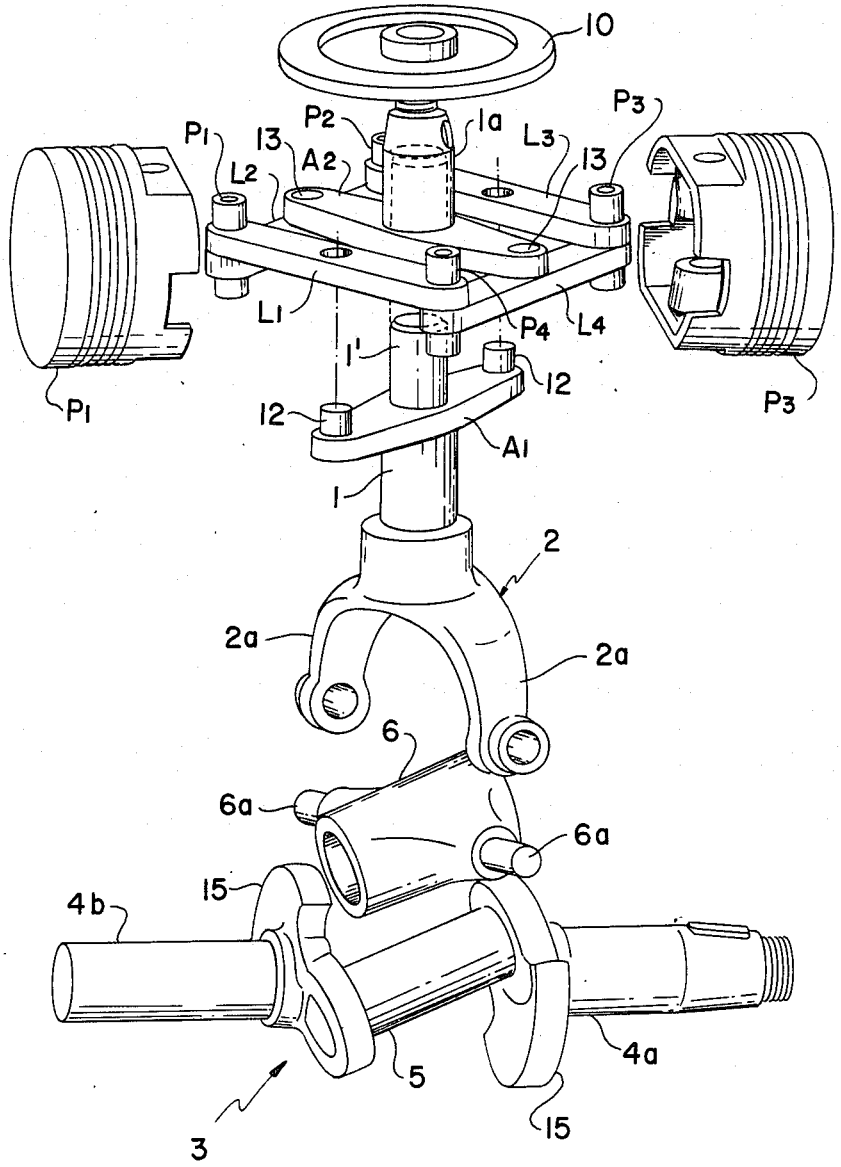
FIG. 1 is an exploded perspective view, partially omitted, of the principal part of the movement converter.

FIG. 1 is an exploded perspective view of the principal parts of the movement converter, in which only a pair of pistons, opposite to each other, are illustrated, and the cylinders are omitted. FIGS. 2-(I) to 2-(IV) are sectional plan views illustrating the acting sequency of the principal parts in the cylinders of the engine and its pertinent part together with a motion of valves being illustratively described in a clear manner.

The four cylinders are disposed crosswise, keeping an equal distance from the intersecting point of the shaft lines, such that two groups of a pair of cylinders $C_1$ & $C_3$ and $C_2$ & $C_4$, being disposed oppositely to each other on the same shaft line, have their shaft lines intersected perpendicularly to each other on one plane. Each of the cylinders is equipped with suction valves $V_1$, $V_2$, $V_3$, and $V_4$, exhaust valves $V_1'$, $V_2'$, $V_3'$, and $V_4'$, and spark plugs (not shown). The end parts of the four equilateral links $L_1$, $L_2$, $L_3$, and $L_4$ are connected to the piston pins $p_1$, $p_2$, $p_3$, and $p_4$ respectively of the pistons $P_1$, $P_2$, $P_3$, and $P_4$ in the cylinders such that the piston pins adjoining to each other are connected thereto. Namely, one end of the links $L_1$ and $L_2$, the links of $L_2$ and $L_3$, the links $L_3$ and $L_4$, and the links $L_4$ and $L_1$ are interactively connected to the piston pin $p_1$ of the piston $P_1$, the piston pin $p_2$ of the piston $P_2$, the piston pin $p_3$ of the piston $P_3$, and the piston pin $p_4$ of the piston $P_4$, respectively, so that a quadrangle constituted by the four equilateral links is changeable in a positional shape. The end parts of the cross arms $A_1$ and $A_2$, crossed in an X-shaped manner, are interactively connected to the middle points of the two groups of a pair of parallel links $L_1$ and $L_3$ and $L_2$ and $L_4$ being opposite to each other, the links can be freely rotated to and fro on the interactive connecting points.

The two groups of a pair of parallel links $L_1$ and $L_3$ and $L_2$ and $L_4$ opposite to each other can access to or be remote from the crossing point of the cross arms. In response to which, the aforementioned cross arms $A_1$ and $A_2$ are moved nearer to or farther from each other with the crossing point as a center. Subsequently, the movable shaft 1, being located at the intersecting position of the cross arms, is fixed to the lower cross arm $A_1$ such that the movable shaft 1 becomes perpendicular to the actuating face of the arm $A_1$ and is supported in a backward and forward rotatable manner. Similarly, the movable shaft 1*a* is fixed to the upper cross arm $A_2$ under the condition where the movable shaft 1*a* is slidably fitted onto the thin shaft part 1' of the lower movable shaft 1 such that the two movable shafts 1 and 1*a* can be moved in directions opposite to each other in a shaking manner, and the movable balance weight 10 is fixed to the upper end of the movable shaft 1*a*. Although the embodiment provides the movable balance weight 10, it is not always needed in the case of a small type engine.

Under such an arrangement, when one group of pistons opposite to each other in the cylinder make an access to each other, another group of pistons being opposite to each other become remote from each other. Similarly, when the pistons, being opposite to each other, which have moved near to each other, become remote from each other, another group of pistons, being opposite to each other, make an access to each other. The movable shafts fixed to the cross arms give rise to the shaking motion. A pair of arm pins 12, 12, fixed to the lower cross arm $A_1$, are connected to the middle points respectively of a pair of parallel links $L_1$ and $L_3$, and cause the cross arm $A_1$ to be moved in a shaking manner upon sequentially receiving a force from the four pistons $P_1$, $P_2$, $P_3$, and $P_4$. Whereas link pins 13, 13 are fixed to the links $L_2$ and $L_4$ in such a manner that the upper cross arm $A_2$ is adapted to be connected to a pair of parallel links $L_2$ and $L_3$. The yoke 2 is fixed to the lower side of the movable shaft 1 which is fixed to the lower cross arm $A_1$. The perpendicular connecting bearing 6 includes two sides which are both equipped with movable pins 6*a* and 6*a* perpendicularly to the shaft line of the bearing portion which is movable in a shaking manner and hung between the arms 2*a* and 2*a* branching from the end fork of the yoke 2. The perpendicular connecting bearing 6 has the bearing portion fitted slidably along the crank pin 5 and being located at the central part of the Z crank shaft 3 which is provided on the lower position of the movable shaft 1 such that the Z crank shaft becomes perpendicular to a direction of the shaft line of the aforementioned movable shaft 1.

The Z crank shaft 3 includes a spindle 4*a* and a sub-shaft 4*b* of the rotational shaft located on both sides of the crank pin 5 and mounted pivotally to the bearing. The Z crank shaft 3 is rotated by a shaking motion of the yoke 2, and the rotational balance weight 15 and 15 are provided continuously to the supporting part of the crank pin 5 on both the sides of the crank pin 5 which is provided such that the crank pin 5 is connected in an inclining manner to the shaft line of the aforementioned shafts 4*a* and 4*b*.

Figure 3:
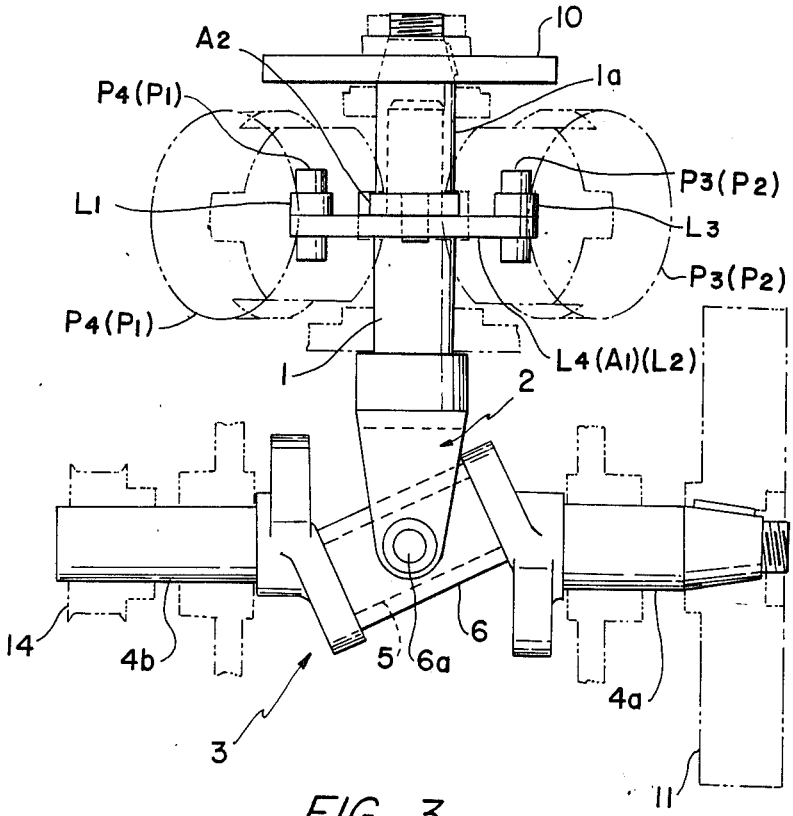
FIG. 3 is a side view of the state where the principal parts of the device are combined with one another.
Figure 4A:
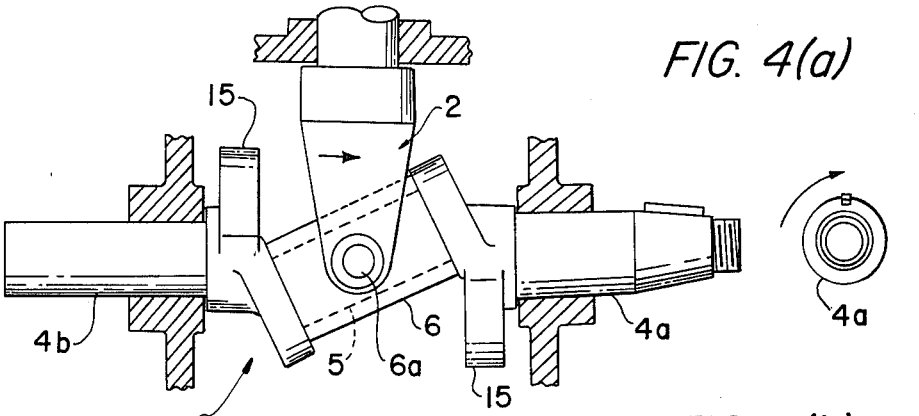
FIGS. 4-(*a*), 4-(*b*), 4-(*c*), and 4-(*d*) are side views of the action sequence between the shaking motion of the yoke and the rotation of the Z crank shaft and a corresponding end view of the shaft.
Figure 4B:
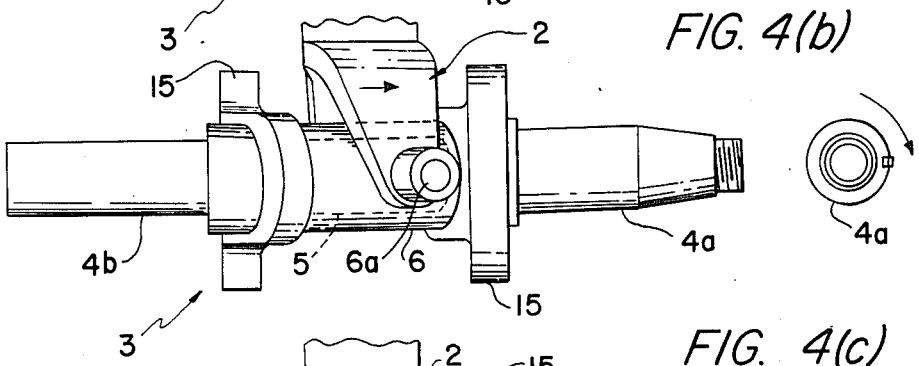
Figure 4C:
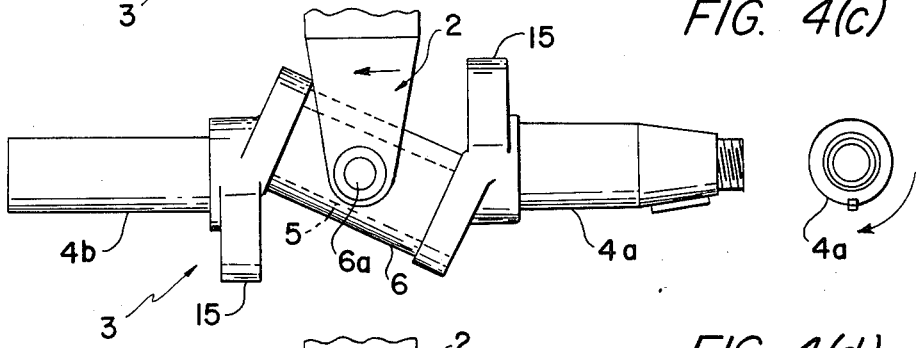
Figure 4D:
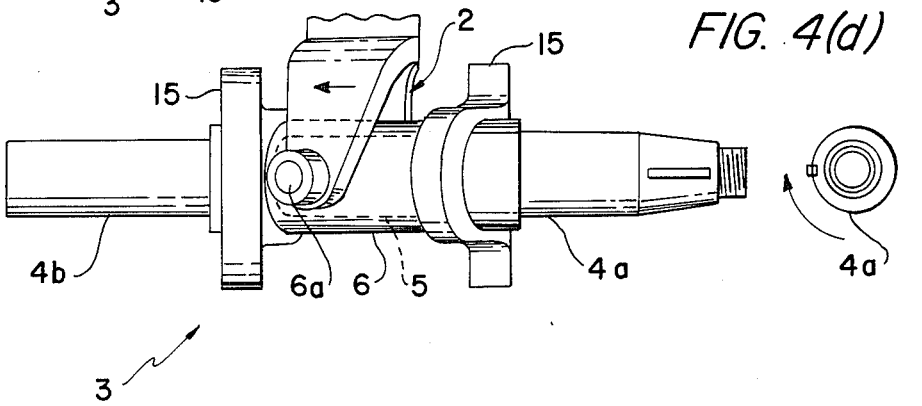

FIG. 3 illustrates a side view of the combination of the principal parts of the device with one another. The spindle 4*a* serving as one rotational shaft of the aforementioned Z crank shaft 3, is equipped with a fly wheel 11 and functions to transmit the rotational force to the outside with the help of using a clutch mechanism which is an already known means. Furthermore, a synchronous pulley 14 is fixed to the sub-shaft 4*b* and is located on the side opposite to the spindle 4*a* of the Z crank shaft 3 to permit a cam (not shown) to be rotated by way of a timing belt. This rotation opens and closes the suction valves $V_1$, $V_2$, $V_3$, and $V_4$ and the exhaust valves $V_1'$, $V_2'$, $V_3'$ and $V_4'$, shown in FIGS. 2-(I) to 2-(IV), at a predetermined time in response to the motion of the pistons $P_1$, $P_2$, $P_3$, and $P_4$. In addition to the aforementioned arrangement, spark plugs (not shown) are ignited with the help of an ignition electric generator continuously at a predetermined time in response to the motion of the selector piston. The rotational shaft 4*a* and 4*b* and the movable shafts 1 and 1*a* are adequately equipped with bearings. The flywheel 11 is provided on the spindle 4*a* of the rotational shaft.

Next, a description of the actuation of a 4-cylinder & 4-cycle gasoline engine equipped with the aforementioned movement converter is set forth as follows:

Referring first to FIG. 2-(I), the spark plug (not shown) of the cylinder $C_1$ among the cross type cylinders is ignited, gasified fuel which is compressed as shown in FIG. 2-(IV) is exploded and the piston $P_1$ is pushed to the central direction of the cross type cylinder. The link $L_1$ which is connected to the piston pin $p_1$ causes cross arm $A_1$ on the movable shaft 1 which is rotatable supported to and fro to be rotated counterclockwise. At the same time, the link $L_3$, opposite to the line $L_1$ under the condition where the links become parallel with each other, is pushed at a middle point from a position as shown in FIG. 2-(IV) in a counterclockwise direction, and the piston $P_2$ is pushed in a direction of being remote from the center of the cross type cylinder, i.e., in a direction toward the cylinder head of the cylinder $C_2$. At that time, the section valve $V_2$ and the exhaust valve $V_2'$ of the cylinder $C_2$ are under a state of being closed, and the external air sucked in as shown in FIG. 2-(IV) is compressed. The piston $P_3$ in the cylinder $C_3$ is permitted to be drawn from the position of being pushed in a direction of the head of the cylinder $C_3$ as shown in FIG. 2-(IV) into the central direction of the cross type cylinder by a counterclockwise movement of the middle point of the link $L_3$ caused by the counterclockwise rotation of the cross arm $A_1$, and, at the same time, the suction valve $V_3$ achieves the position of being opened, whereby the external air is sucked into the cylinder $C_3$.

Furthermore, the counterclockwise movement of the middle point of the link $L_1$ permits the piston $P_4$ in the cylinder $C_4$ to be pushed from the position of being near to the center of the cross type cylinder as shown in FIG. 2-(IV) into the direction toward the cylinder head, and, at the same time, the exhaust valve $V_4'$ achieves the position of being opened, whereby the combustion gas after being exploded in the cylinder $C_4$ as shown in FIG. 2-(IV) is exhausted. On the other hand, when an explosion causes the piston $P_1$ in the cylinder $C_1$ to be pushed in, the upper cross arm $A_2$ the end parts of which are interactively mounted to the middle points respectively of links $L_2$ and $L_4$, which are positioned opposite to each other, is rotated from such a position as shown in FIG. 2-(IV) in the clockwise direction, and the upper movable shaft 1*a* fixed onto the cross arm $A_2$ is rotated clockwise. Namely, when the gasified fuel compressed in the cylinder $C_1$ as shown in FIG. 2-(IV) is exploded, from the condition of FIG. 2-(IV) to the condition of FIG. 2-(I), the lower cross arm $A_1$ and the upper cross arm $A_2$ are adapted to be rotated counterclockwise and clockwise respectively. Under the aforementioned actuation, the strike of the pistons and the backward and forward rotating amount of the cross arms are restricted by a moving range of the crank pin 5 made at the time when the double sided spherical sliding motion of the perpendicular connecting bearing 6 caused by the counterclockwise rotation of the yoke 2 connected directed to the cross arm $A_1$ permits the Z crank shaft 3 to be rotated by 180°.

Next, when an ignition of the spark plug (not shown) causes an explosion of the gasified fuel compressed in the cylinder $C_2$ of FIG. 2-(I), the pistons, the links, and cross arms are transferred to a position as shown in FIG. 2-(II). Namely, the piston $P_2$ in the cylinder $C_2$ is pushed in the central direction of the cross type cylinder, and, at the same time, the suction valve $V_3$ of the cylinder $C_3$ which is initially in the position of being opened is closed, whereby the gasified fuel sucked in the cylinder $C_3$ is compressed. Concurrently, upon closing of the exhaust valve $V_4'$ of the cylinder $C_4$ which is in the condition of being opened and opening of the suction valve $V_4$, a drawing-in of the piston $P_4$ toward the central direction of the cross type cylinder causes the external air to be sucked into the cylinder $C_4$, while, upon opening of the exhaust valve $V_1'$ in the cylinder $C_1$, a pushing-in of the piston $P_1$ in a direction of the cylinder head causes the exploded combustion gas in the cylinder $C_1$ to be exhausted. At that time, a pressurized movement of the piston $P_2$ toward the central direction of the cross type cylinder causes the links to be moved in such a manner as referred to above and the lower cross arm $A_1$ and the upper cross arm $A_2$ to be rotated clockwise and counterclockwise respectively, whereby the double-sided spherical sliding motion of the perpendicular connecting bearing 6 caused by the clockwise rotation of the yoke 2 connected to the cross arm $A_1$ permits the Z crank shaft 3 to be rotated by 180°. One reciprocating motion in a shaking manner of the cross arm $A_1$ allows one rotation of the Z crank shaft 3.

When an ignition of the spark plug (not shown) causes an explosion of the gasified fuel compressed in the cylinder $C_3$ of FIG. 2-(II), the pistons, the links, and the cross arms are transferred to a position as shown in FIG. 2-(III). When the piston $P_3$ in the cylinder $C_3$ is pushed toward the central direction of the cross type cylinder and, at the same time, the piston $P_4$ in the cylinder $C_4$ is pushed toward a direction of the cylinder head, the gasified fuel sucked in is compressed, a movement of the piston $P_1$ in the cylinder $C_1$ causes the external air to be sucked into the cylinder $C_1$, and a pushing-in of the piston $P_2$ in the cylinder $C_2$ toward a direction of the cylinder head causes the exploded combustion gas in the cylinder $C_2$ to be exhausted in such a manner as referred to above. A movement of the links caused by a pressurized movement of the piston $P_3$ toward the central direction of the cross type cylinder permits the lower cross arm $A_1$ and the upper cross arm $A_2$ to be rotated counterclockwise and clockwise, respectively. Whereby, the double-sided spherical sliding motion of the perpendicular connecting bearing 6 caused by the counterclockwise rotation of the yoke 2 connected directly to the cross arm $A_1$ permits the Z crank shaft 3 to be rotated by 180°. Next, when the gasified fuel compressed in the cylinder $C_4$ of FIG. 2-(III) is exploded, along a sequential development identical to that of the above description, the lower cross arm $A_1$ and the upper cross arm $A_2$ are adapted to be rotated clockwise and counterclockwise respectively, whereby the clockwise rotation of the yoke 2 permits the Z crank shaft 3 to be rotated by 180°. Subsequently, an explosion of the gasified fuel being compressed in the cylinder $C_1$ of FIG. 2-(IV) results in the positioning as shown in FIG. 2-(I). Namely, a continuous explosion of the gasified fuel compressed in the four cross type cylinders $C_1$, $C_2$, $C_3$, and $C_4$ allows the cross arms $A_1$ and $A_2$ to be reciprocally moved in a shaking manner two times and the Z Crank shaft 3 to be rotated twice. A timing control cam (not shown) for the aforementioned suction valves, exhaust valves, spark plugs, and the like, is rotated once for every two rotations of the Z crank shaft 3 to perform a control of the timing.

FIGS. 4-(*a*) to 4-(*d*) illustrate the positioning of the elements where one process of a reciprocating motion in a shaking manner of the yoke 2 causes the Z crank shaft 3 to be rotated once. FIG. 4-(*a*) shows the position where the shaking moving direction of the yoke 2 adopts a neutral position with respect to the direction of the shaft line of the Z crank shaft 3. If the yoke 2 is adapted to be rotated from the position as shown in FIG. 4-(*a*) to a counterclockwise direction taken from the upper part of the drawing, it causes the perpendicular connecting bearing 6 which is supported between the arms branching from the yoke 2 by the movable pins 6*a* and 6*a* to give rise to the double-sided spherical sliding motion so that when the yoke 2 reaches the position of ending its backward and forward rotation, the perpendicular connecting bearing 6 achieves the state as shown in FIGS. 4-*b*. Thus, as shown in the end view of the rotational shaft 4*a*, the rotational shaft 4*a* is rotated by 90°. Subsequently, if the yoke is rotated in an opposite direction (clockwise direction taken from the upper part thereof), the perpendicular connecting bearing 6 continues the double-sided spherical motion, and, by way of such a state as shown in FIG. 4-(*c*), the yoke 2 reaches the position of ending its backward and forward rotation opposite to the state of FIG. 4-(*b*) as shown in FIG. 4-(*d*). Thus, the rotational shaft 4*a* is rotated from the state of FIG. 4-(*b*) by 180°.

Further, when the yoke 2 is rotated in an opposite direction (clockwise direction taken from the upper part thereof) so that it achieves a neutral state as shown in FIG. 4-(*a*), the rotational shaft 4*a* is further rotated by 90°. Whereby, a return of the yoke 2 from the state of FIG. 4-(*a*) to the original state made during the shaking motion thereof will allow the rotational shaft, i.e., the Z crank shaft to be rotated once. Such a rotation of the Z crank shaft 3 may take place from whatever position one process of the reciprocating motion of the yoke 2 starts from. For example, the yoke 2 may utilize one process of reciprocating shaking motion from the state of FIG. 4-(*b*) and return to the state of FIG. 4-(*b*). Furthermore, whatever relative position is adopted for the mounting direction between the cross arm $A_1$ and the yoke 2, only if each of the four cylinders $P_1$, $P_2$, $P_3$, and $P_4$ is continuously actuated does a shaking motion of the yoke 2 allow the Z crank shaft 3 to be twice rotated.

The Z crank shaft 3 has an unbalance of the couple offset by means of the rotational balance weights 15 and 15 on both ends of the crank pin. A motion of the perpendicular connecting bearing 6 utilizes the aforementioned rotational balance weights 15 and 15 as well as the movable balance weight 10 which moves in a shaking manner in a direction reverse to the cross arm $A_1$ in keeping its balance, thereby making it possible to reduce the vibration.

Figure 5:
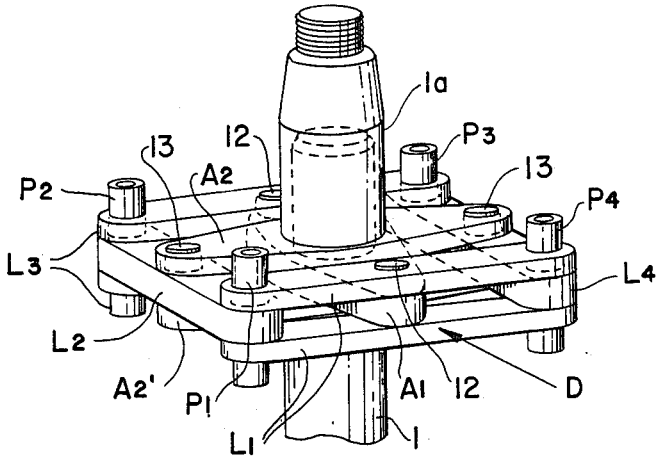
FIG. 5 is a perspective view of another embodiment in which the parallel links and the cross arms are combined with one another in a different manner.

FIG. 5 illustrates an arrangement in which a combined assortment between the portion of the parallel links and the portion of the cross arms is contrived, thereby making the structure more rigid. The arrangement includes links for conveying a force from the pistons to the cross arm $A_1$ on the upper part of the movable shaft 1 to be fixed to the yoke 2 which is doubled so that no twisting moment may be given to the arm $A_1$. Namely, the cross arm $A_1$ and both the end parts of the parallel links $L_2$ and $L_4$ on both the sides of said cross arm $A_1$ are interposed between two vertical pairs of parallel lines $L_1$ & $L_1$ and $L_3$ and $L_3$. The two vertical pairs of parallel lines $L_1$ & $L_1$ and $L_3$ and $L_3$ are connected to the cross arm $A_1$ and the pistons $P_1$, $P_2$, $P_3$, and $P_4$ by the arm pins 12 and 12 and the piston pins $p_1$, $p_2$, $p_3$, and $p_4$, respectively. Furthermore, the sub-cross arm $A_2'$ is provided to be slidably fitted onto the movable shaft 1 together with the upper cross arm $A_2$ such that the sub-cross arm $A_2'$ and the upper cross arm $A_2$ interpose the other parallel links $L_2$ and $L_4$ and the cross arm $A_4$. The arm $A_2'$ is connected to the parallel links $L_2$ and $L_4$ by the link pins 13 and 13.

Figure 6:
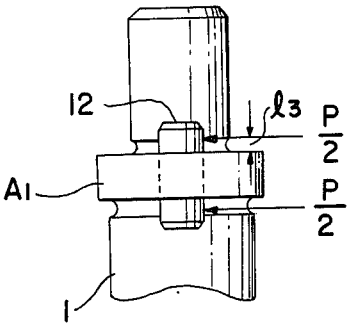
FIG. 6 is a view of the cross arm $A_1$ taken from the direction of arrow D of FIG. 5.
Figure 7:
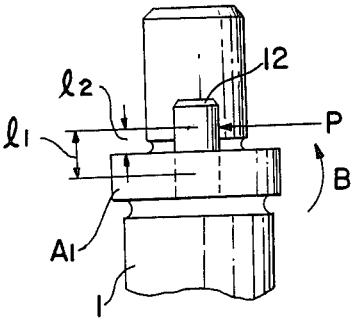
FIG. 7 is a view of the part illustrated in FIG. 6 and correspondingly to the first embodiment.

As shown in FIG. 6 taken from the direction of arrow D in FIG. 5 of the cross arm $A_1$, the force P being conveyed from the piston pin $P_4$ to the cross arm $A_1$ by means of the parallel links $L_1$ and $L_1$, has each of its halves P/2 imposed upon the lower and upper parts respectively of the arm pin 12 which is provided such that the arm pin 12 is extruded from the upper part and the lower part of the cross arm $A_1$. For this reason, the upper and lower twisting moments imposed upon the arm $A_1$ are offset. The twisting moment $\beta = Pl_1$, as shown in FIG. 7 illustrating the condition where the link $L_1$ is single, the force P imposed upon the cross arm $A_1$ does not take place. As for the stress imposed upon the arm pin 12, since force P is vertically divided into two equal portions in the case of FIG. 6, the bending moment received by the arm pin 12 is $P/2 \times l_3$, whereas in the case of FIG. 7, the bending moment becomes $P \times l_2$. Taking consideration of the design board thickness of the links presents the relationship of $l_2 = 2l_3$. The bending moment received by the pin of FIG. 7 becomes $P \times l_2 = 2P \times l_3$, and the bending moment received by the arm pin 12 of FIG. 6 becomes $\frac{1}{4}$ of the bending moment of FIG. 7. Furthermore, since the shearing stress is reduced by half, an extremely favorable result in terms of the strength of the arm pin is obtained. For this reason, the stress imposed upon the cross arm $A_1$ also is reduced so that a structure of high rigidity can be attained. Furthermore, when the force is imposed upon one of the parallel links $L_2$ and $L_4$ being opposite to each other and the force is conveyed to another link, the sub-cross arm $A_2'$ which is provided together with the upper cross arm $A_2$ gives rise to a more favorable situation from the point of view of the bending moment imposed upon the link pin 13 and the shearing stress than the case where the upper cross arm $A_2$ is provided as a single unit. Thus, a double construction helps reinforce the structure. Such a link mechanism of high rigidity is suitable for being used in an engine and the like.

In addition to the case of the aforementioned embodiment wherein the movement converter according to the present invention is sued in an engine, this type of movement converter may be also suitably used for the situation where only two cylinders being opposite to each other are used for the engine, while the other two cylinders connected directly thereto are used as a compressor. The latter situation fulfills a marked miniaturization of the structure in comparison with the common compressor equipped with an engine. The parallel links directly push the piston on the side of the compressor, so that a compressor which is lower in frictional loss and higher in efficiency in comparison with the mechanism of interposing the transmitting process between the crank shaft and the connecting rod can be realized.

Furthermore, by driving rotationally the Z crank shaft of the movement converter according to the present invention as the input shaft, it is possible that the cylinders which are disposed crosswise may be used as a compressor. Also in this situation, it is possible that as a four-cylinder compressor a machine may be constructed which is well-balanced, smaller, higher in efficiency and reduces the amount of vibration.

In the case of using the movement converter according to the present invention as an engine, further to an application to the four-cycle engine found in the aforementioned embodiment, it may be applied to all types of engines such as the two-cycle type and the Diesel.

It is apparent from the aforementioned description that, according to the present invention, since the four cylinders are disposed crosswise, the four equilateral links permit the shaking motion to be taken out from the reciprocating motion of the pistons. The Z crank shaft allows the shaking motion to be converted by way of the perpendicular connecting bearing to the rotational motion. The motion of the pistons and the links is fully balanced and all the vibration including an even number of vibration such as other lateral vibration and the primary vibration based on the reciprocating motion of the pistons are offset to be absorbed. In addition, the balance weights on both the ends of the crank pin cause the unbalance of the couple along the Z crank shaft to be reduced to nil. The shaking motion of the yoke actuating the Z crank shaft can also be reduced in its angular vibration by using the movable balance weight, so that a well-balanced construction of the entirety of the device including the balance of the motion of the pistons can be attained. Thus, it is possible to reduce the amount of vibration. In particular, since the part for transmitting the motion adopts a rolling contact comprising the surfce contact and a multiplicity of contact parts such as ball bearings, a device of higher durability can be provided.

In the situation where the present device is utilized as an engine, the engine is an improvement in terms of being airtight, lubrication and cooling. In addition, the engine utilizes a running reliability which the reciprocating engine now has and it is constructed by mechanical parts which are of higher reliability and has a marked actual improvement, as a product which is better balanced, is smaller and lighter, and is higher in mechanical efficiency than the model found provided in the conventional reciprocating type engine. Further, since the resulting shaking motion is transmitted from the reciprocating motion of the pistons through the four equilateral link mechanisms to the yoke, and the Z crank shaft to the perpendicular connecting bearing only by the movable pin, the structure is extremely simple. The Z crank shaft having one inclined crank pin as one of constituent parts, for example, in comparison with the crank shaft of a series 4-cylinder engine, is not only simpler but lighter in structure, and is able to minimize the distance between the bearings on both the ends. Thus, the rigidity of the shaft is increased particularly the twisting rigidity causing the vibration to become larger and giving rise to a favorable situation. Since the torque taking place on the Z crank shaft as the output shaft adopts a form of the couple, in contrast with the general crank in which the moment load has to incur the torque, the load upon the bearing is reduced by half. The frictional loss is reduced and the vibration and the noise are reduced. The aforementioned minimizing of the distance between the bearings is suitable for loading a front engine and front drive type car which has been most frequently found in the market at present with the device. Making the bearing compact allows the rigidity of the entirety of the engine to be extremely higher, resulting in a light mechanism. In the case where the present device incorporated into the engine is utilized for a light airplane, if a loading thereof is made, while the cylinder block and the Z crank shaft are located at the lower part and the upper part respectively, a stabilized layout in which the center of gravity is lowered is attained. Because there is no portion over the Z crank shaft, the angular range of view becomes better. The cylinders are independent and are favorable particularly as an air-cooling type engine. Since the present mechanism, by itself, is so good in balance that, with the airplane needing particularly a minimizing of the body weight, the vibration causing a discomfort is reduced, thereby simplifying a countermeasure against the vibration. Thus, the present device has an advantage of a higher degree of freedom in arrangement of the parts, because it has the movable shaft from the piston and the Z crank shaft intersected perpendicularly to each other.

On the other hand, if only the two cylinders being opposite to each other of the present device are used for the engine, whereas the other two cylinders intersecting perpendicularly thereto are used for the compressor, the air compressor equipped with the engine, of a small type, which is good in balance and has a high efficiency, can be realized. In addition, if all the four cylinders are used for the compressor with the Z crank shaft serving as the input shaft, a compressor which is good in balance and can reduce the amount of vibration can be realized. To sum up, the movement converter of the present invention, as a device which reduces the vibration amount, is better in reliability and durability, and can be made compact and light, and may be applicable to various kinds of fields.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A movement converter for use in a combustion engine wherein a reciprocating motion of a piston is converted to the rotational motion of an output shaft comprising:

four cylinders arranged in a crosswise disposition of oppositely disposed pairs and including shaft lines extending along the cylinders and being in the same plane so that shaft lines of oppositely disposed pairs of cylinders are perpendicular relative to each other;

a first piston, a second piston, a third piston and a fourth piston, each piston being operatively positioned for reciprocation within a corresponding one of said four cylinders;

a first link having a first end operatively connected to said first piston, a second end operatively connected to said fourth piston and a middle portion;

a second link having a first end operatively connected to said second piston, a second end operatively connected to said first piston and a middle portion;

a third link having a first end operatively connected to said third piston, a second end operatively connected to said second piston and a middle portion;

a fourth link having a first end operatively connected to said fourth piston, a second end operatively connected to said third piston and a middle portion;

a first cross arm having a first end operatively connected to substantially said middle portion of said first link and a second end operatively connected to substantially said middle portion of said third link;

a second cross arm having a first end operatively connected to substantially said middle portion of said second link and a second end operatively connected to substantially said middle portion of said fourth link;

said first and second cross arms intersecting each other in substantially an X-shape;

a movable shaft operatively connected to said first cross arm at approximately the intersection of said first and second cross arms and being substantially perpendicular to an actuating face of said cross arm for rotation to and fro;

a yoke affixed to one end of said movable shaft, said yoke including two arms projecting away from said movable shaft;

a Z crank shaft having a shaft line which substantially perpendicularly intersects a shaft line of said movable shaft;

a crank pin being a portion of said Z crank shaft and arranged in an inclined disposition relative to the shaft line of said Z crank shaft; and a perpendicular connecting bearing slidably fitted in relationship to said crank pin and including pins projecting substantially perpendicularly to said perpendicular connecting bearing and being received in apertures in said arms of said yoke for transmitting the to and fro rotation of said movable shaft to said perpendicular connecting bearing;

wherein reciprocating motion of said pistons is transferred by said links to a to and fro motion imparted to said movable shaft which is transmitted to said perpendicular connecting bearing to remove a swinging motion of said pistons and impart a rotational motion to said Z crank shaft through the connection of said perpendicular connecting bearing and said crank pin.

2. A movement converter according to claim 1, wherein said first link consists of two links with a first end operatively connected to said first piston and a second end operatively connected to said fourth piston and said first cross arm being operatively connected to substantially the middle portion and being positioned inbetween the two links of the first link for reducing a twisting moment transferred to the first cross arm.

3. A movement converter according to claim 1, wherein one group of two opposed cylinders is used as an engine and the second group of two opposed cylinders is used as a compressor.

4. A movement converter according to claim 1, and further including a second movable shaft affixed to said second cross arm and being movable in opposite directions relative to said first movable shaft, a balance weight fixed to said second movable shaft for balancing the movement of said second movable shaft.

5. A movement converter according to claim 1, and further including rotational balance weights affixed to said Z crank shaft for reducing vibration.

6. A movement converter according to claim 1, wherein said pins disposed substantially perpendicularly on said perpendicular connecting bearing are movable pins.

7. A movement converter according to claim 1, wherein said first, second, third and fourth links are operatively connected to said first, second, third and fourth pistons by pins for permitting limited rotary motion between said links as said pistons reciprocate.

8. A movement converter for use in an air compressor wherein a rotational motion of an input shaft is converted to a reciprocating motion of a piston comprising:

four cylinders arranged in a crosswise disposition of oppositely disposed pairs and including shaft lines extending along the cylinders and being in the same plane so that shaft lines of oppositely disposed pairs of cylinders are perpendicular relative to each other;

a first piston, a second piston, a third piston and a fourth piston, each piston being operatively positioned for reciprocation within a corresponding one of said four cylinders;

a first link having a first end operatively connected to said first piston, a second end operatively connected to said fourth piston and a middle portion;

a second link having a first end operatively connected to said second piston, a second end operatively connected to said first piston and a middle portion;

a third link having a first end operatively connected to said third piston, a second end operatively connected to said second piston and a middle portion;

a fourth link having a first end operatively connected to said fourth piston, a second end operatively connected to said third piston and a middle portion;

a first cross arm having a first end operatively connected to substantially said middle portion of said first link and a second end operatively connected to substantially said middle portion of said third link;

a second cross arm having a first end operatively connected to substantially said middle portion of said second link and a second end operatively connected to substantially said middle portion of said fourth link;

said first and second cross arms intersecting each other in substantially an X-shape;

a movable shaft operatively connected to said first cross arm at approximately the intersection of said first and second cross arms and being substantially perpendicular to an actuating face of said cross arm for rotation to and fro;

a yoke affixed to one end of said movable shaft, said yoke including two arms projecting away from said movable shaft;

a Z crank shaft having a shaft line which substantially perpendicularly intersects a shaft line of said movable shaft;

a crank pin being a portion of said Z crank shaft and arranged in an inclined disposition relative to the shaft line of said Z crank shaft; and a perpendicular connecting bearing slidably fitted in relationship to said crank pin and including pins projecting substantially perpendicularly to said perpendicular connecting bearing and being received in apertures in said arms of said yoke for transmitting the to and fro rotation of said movable shaft to said perpendicular connecting bearing;

wherein rotary motion imparted to said Z crank shaft is transfered to said perpendicular connecting bearing and said crank pin to impart a to and fro rotation to said links for reciprocating said pistons for compressing a gas disposed within said cylinders.

9. A movement converter according to claim 8, wherein said first link consists of two links with a first end operatively connected to said first piston and a second end operatively connected to said fourth piston and said first cross arm being operatively connected to substantially the middle portion and being positioned inbetween the two links of the first link for reducing a twisting moment transferred to the first cross arm.

10. A movement converter according to claim 8, and further including a second movable shaft affixed to said second cross arm and being movable in opposite directions relative to said first movable shaft, a balance weight fixed to said second movable shaft for balancing the movement of said second movable shaft.

11. A movement converter according to claim 8, and further including rotational balance weights affixed to said Z crank shaft for reducing vibration.

12. A movement converter according to claim 8, wherein said pins disposed substantially perpendicularly on said perpendicular connecting bearing are movable pins.

13. A movement converter according to claim 8, wherein said first, second, third and fourth links are operatively connected to said first, second, third and fourth pistons by pins for permitting limited rotary motion between said links as said pistons reciprocate.

* * * * *